United States Patent [19]

Muz

[11] Patent Number: 4,647,138

[45] Date of Patent: Mar. 3, 1987

[54] ELECTRICAL CONNECTOR AND PROCESS FOR ITS MANUFACTURE

[75] Inventor: Edwin Muz, Reutlingen, Fed. Rep. of Germany

[73] Assignee: Nicolay GmbH, Stuttgarter Strasse, Fed. Rep. of Germany

[21] Appl. No.: 731,032

[22] Filed: May 6, 1985

[30] Foreign Application Priority Data

May 8, 1984 [DE] Fed. Rep. of Germany ..... 3416905

[51] Int. Cl.[4] ..... H01R 9/05

[52] U.S. Cl. ..... 339/147 P; 339/177 R

[58] Field of Search ..... 339/143 R, 147 R, 147 P, 339/DIG. 3, 177 R, 177 E

[56] References Cited

U.S. PATENT DOCUMENTS

| | | | |
|---|---|---|---|
| 3,302,159 | 1/1967 | Schumacher | 339/177 R |
| 3,768,063 | 10/1973 | Coffman | 339/177 E |
| 4,074,926 | 2/1978 | Broad | 339/DIG. 3 |
| 4,199,736 | 4/1980 | McTaggart et al. | 339/147 P |
| 4,208,085 | 6/1980 | Lawrence et al. | 339/103 C |
| 4,266,844 | 5/1981 | Chelminski | 339/218 M |
| 4,280,507 | 7/1981 | Rosenberg | 128/696 |
| 4,397,516 | 8/1983 | Koren et al. | 339/177 R |
| 4,497,533 | 2/1985 | Genova et al. | 339/143 R |

*Primary Examiner*—Gil Weidenfeld
*Assistant Examiner*—Gary F. Paumen
*Attorney, Agent, or Firm*—Roylance, Abrams, Berdo & Goodman

[57] ABSTRACT

An electrical connector attached to a coaxial cable has two contacts connected with the cable inner and outer conductors and a housing about a shield. To provide a simple and low-cost electrical connector, an electrical element is surrounded by insulation and is mounted in an electrically insulated cast element. The part of the cast element inside the housing is surrounded by an electrically conductive plastic shield, which shield is electrically connected with the cable outer conductor and one of the contacts.

9 Claims, 1 Drawing Figure

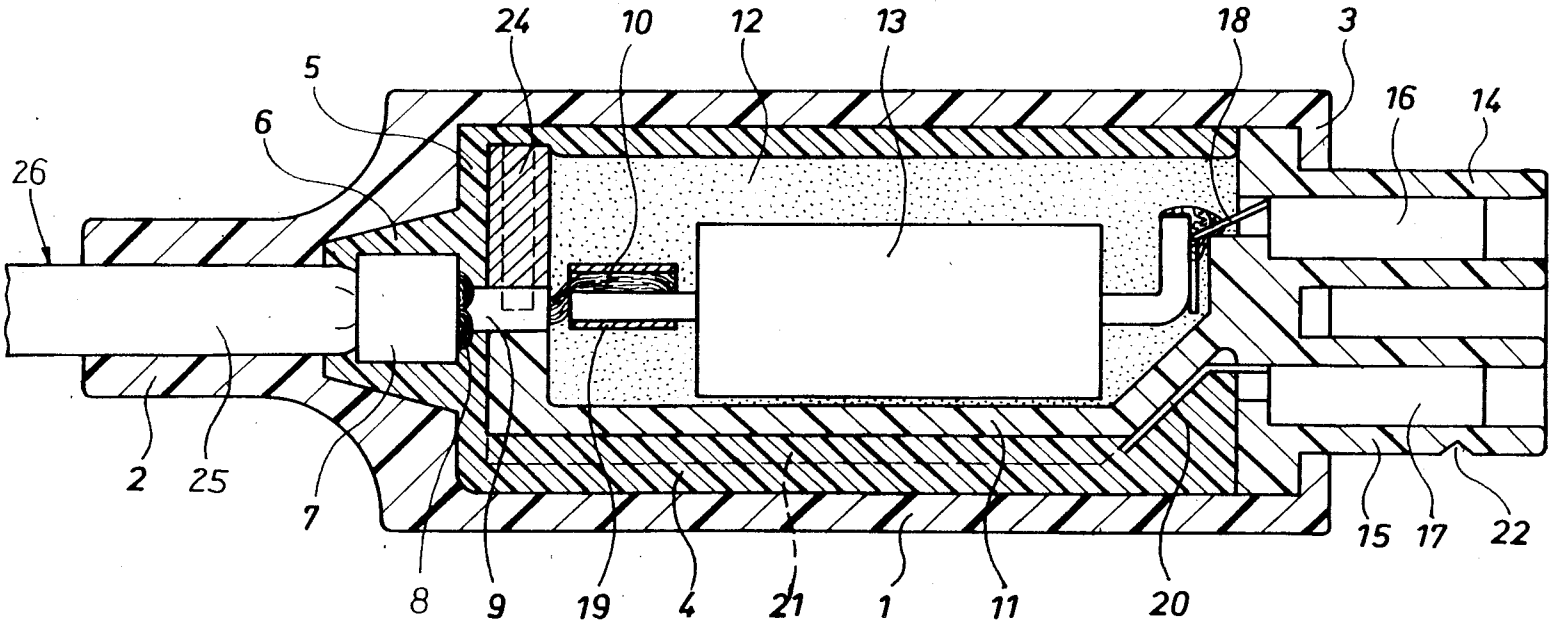
14
16
3
18
13
12
10
24
5
6
26
22
17
15
20
11
1
21
4
19
9
8
7
25
2

ELECTRICAL CONNECTOR AND PROCESS FOR ITS MANUFACTURE

FIELD OF THE INVENTION

The present invention relates to an electrical connector with two contacts attached to the inner and outer conductors of a coaxial cable and with an electrical element surrounded by a shield in its housing.

BACKGROUND OF THE INVENTION

In conventional electrical connectors for coaxial cables with electrical elements, contacts formed as bearing sleeves are arranged in the front of a housing in pairs, and spaced from each other. The contacts are connected with electrical conductors surrounded by insulating sheaths, which sheaths are surrounded in turn by insulation within the housing. The electrical conductors surrounded by the insulating sheaths are guided into a tubular member projecting into the housing. The member provides a shield surrounding the electric conductors. The shield is surrounded by an outside plastic sheathing. Such connector is disclosed in U.S. Pat. No. 4,280,507 to Rosenberg. However, conventional connectors of this type are too complex and too expensive.

SUMMARY OF THE INVENTION

An object of the present invention is to provide an electrical connector attached to a coaxial cable which is simple and inexpensive to manufacture.

Another object of the present invention is to provide a process of making an electrical connector on a coaxial cable which is simple and inexpensive.

The foregoing objects are obtained by an electrical connector attached to a coaxial cable with inner and outer conductors, comprising a cast element (produced by injection molding) of electrically insulating material, an electrical element surrounded by an insulation mass mounted in the cast element, a shield of electrically conductive plastic material surrounding the cast element, electrical element and insulation mass, a housing surrounding the shield, and first and second contacts. The inner conductor is connected to the electrical device which is in turn connected to the first contact. The shield is electrically coupled to the outer conductor and the second contact.

The shield, in a simple manner, produces an electrical connection between the sheathing or outer conductor shielding the inner conductor and the respective contact of the electrical connector. The shield is electrically impervious and can be made quite thin.

The cast element can have a holding channel receiving the insulation mass and the electrical element cast integrally within the mass. Preferably, the cast element includes a holding part housing the contacts. By providing a sliding valve in a slot-like aperture in the cast element penetration of the insulating material between the electrical conductor and its insulating sheathing is avoided and overflow of insulating material to the sides of the insulated conductor is prevented.

The foregoing objects are also obtained a process for making an electrical connector on a coaxial cable with inner and outer conductors, the connector including a housing, an electrical element surrounded by an insulation mass and first and second contacts electrically coupled to the inner and outer conductors. The process comprises the steps of mounting the electrical element within a holding channel of a cast element, casting insulation in the holding channel and about the electrical element, spraying or injection molding the cast element including the insulation and electrical element with an electrically conductive plastic producing a shield electrically coupled to the outer conductor and the second contact, and encasing the shield with electrically insulating plastic forming a housing.

Other objects, advantages and salient features of the present invention will become apparent from the following detailed description, which, taken in conjunction with the annexed drawings, discloses preferred embodiments of the present invention.

BRIEF DESCRIPTION OF THE DRAWING

The sole drawing FIGURE which forms a part of this disclosure is a side elevational view in section of an electrical connector according to the present invention.

DETAILED DESCRIPTION OF PREFERRED EMBODIMENTS OF THE INVENTION

Referring to the drawing, the electrical connector of the present invention has a housing 1 of an electrically insulating, soft plastic with a protective rubber sleeve on its left side. A flange 3 projects inwardly on the right side of the housing. Housing 1 surrounds a shield 4 of electrically conductive plastic. The shield is configured as a sheathing, and has a base 5 in the area of protective rubber sleeve 2. Base 5 is provided with a wedge-like neck 6 tapering toward protective rubber sleeve 2.

An electrically conductive contact bush 7 is embedded in neck 6 and is connected to a shielding sheath or outer conductor 8 of the coaxial cable. Outer conductor 8 extends forward of the protective rubber sleeve and is surrounded by an insulating cover 25. The outer conductor shields an electrical inner conductor 10 which is surrounded by an insulating sheath 9. Shield 4 surrounds the conductors in the area of wedge-shaped neck 6.

Shield 4 surrounds a cast or molded element 11, which element has a holding trough or channel receiving an electrical element 13, especially a voltage limiting resistance member, surrounded by an insulation mass 12. Cast element 11 is of hard plastic. On the left side in the drawing, conductor 10 surrounded by the insulating sheathing extends into cast element 11. Contact bush 7 is located at some distance from cast element 11.

Cast element 11 has two supports 14 and 15, arranged one over the other, on the right side of the drawing and extending from a wall. The supports are spaced a distance from each other, and project beyond housing 1. Each support 14 and 15 receives a contact or connector 16 and 17, respectively, e.g. a flexible receptacle for insertion of a plug. Supports 14, 15 seal housing 1 on the side of connectors 16 and 17, and have an outwardly extending flange engaged in housing 1.

On its side adjacent electrical element 13, connector 16 has a contact lug 18 connected to a bent contact of electrical element 13. The opposite side of the electrical element is connected with inner electrical conductor 10 by means of a connecting bush 19 surrounding the end of conductor 10 and another contact of the electrical element. Connector 17 has a contact lug 20 embedded in shield 4. Contact lug 20 extends obliquely along the outside of cast element 11. The cast element has a groove 21 on its bottom in the middle, running parallel to the axes of connectors 16 and 17.

Housing 1 can enclose only a single electrical element 13, a single cast element 11, and a single shield 4. However, it is also possible to arrange several cast elements 11 one after the other at some spacing from each other and to surround them with a common shield 4 and housing 1. In this manner several coaxial cables may be connected on one side of the housing. On the other housing side, several pairs of connectors or contacts 16 and 17 are arranged, with the contacts of each pair lying one over the other. Thus, another electrical connector, having plugs mating with connectors 16 and 17, can be connected directly with the electrical connector, provided the supports of each connector are of different matable outside transverse cross-sectional configurations. A notch 22 is provided on support 15 to receive a tab on the other connector to form a catch connection.

To manufacture the electrical connector on a coaxial cable, one end of coaxial cable 26, having parts 8, 9, 10 and 25, is treated in stages. In a first stage, insulating cover 25, shielding sheath 8, and insulating sheath 9 are removed so that inner conductor 10 is exposed. In a second stage, only insulating cover 25 is removed from the connecting part of cable 26. Shielding sheath 8 is retracted and is pressed on the insulating cover by contact bush 7. Contact bush 7 also provides strain relief for insulating cover 25 and electrically connects the shielding sheath of a metal retriculation with shield 4. Inner conductor 10 is connected by soldering or by connecting bush 19 to electrical element 13.

The electrical element is mounted in hard plastic cast element 11. Inner conductor 10 and insulating sheath 9 pass through a slot-like aperture in cast element 11, which aperture is completely sealed by sliding closure piece 24. Connectors 16 and 17 are previously inserted in cast element 11. The end of electrical element 13 remote from connecting bush 19 is soldered to contact lug 18 of connector 16, which contact lug extends partially parallel to the lead of electrical element 13 connected therewith.

As shown in the drawing, the end of insulating sheath 9 extends into cast element 11. Closure piece 24 can slide in cast element 11 and can be moved into a position in cast element 11 against insulating sheath 9 for crimping the end of insulating sheath 9. Closure piece 24 also seals the slot-like aperture in cast element 11 for introducing insulating sheath 9 into cast element 11.

Following the introduction of electrical element 13 into the holding channel of cast element 11 and following the crimping of the end of insulating sheath 9 by use of closure piece 24, insulation 12 is injected into cast element 11, which insulation completely covers electrical element 13. Thereafter, cast element 11 and insulation mass 12 are sprayed with conductive plastic forming a complete shield 4 over cast element 11, electrical element 12 and insulation mass 12, and electrically coupling the formed shield 4 with contact bush 7, shielding sheath 8 and contact lug 20 of connector 17 on the bottom of cast element 11. Finally, housing 1 and protective rubber sleeve 2 are formed by an additional molding step with an insulating soft plastic.

While various embodiments have been chosen to illustrate the invention, it will be understood by those skilled in the art that various changes and modifications can be made therein without departing from the scope of the invention as defined in the appended claims.

What is claimed is:

1. An electrical connector attached to a cable with first and second conductors, comprising:

a unitary, one piece cast element of electrically insulating material, said cast element having a slot like aperture receiving said first conductor and closed by a plate engaging said first conductor;

an electrical element surrounded by an insulation mass mounted in said cast element, said first conductor being electrically coupled to said electrical element, said plate preventing said insulation mass from leaking out of one end of said cast element;

a shield of electrically conductive plastic surrounding said cast element, said electrical element and said insulation mass, said shield being electrically coupled to said second conductor;

a housing surrounding said shield; and first and second electrical contacts, said first contact electrically coupled to said electrical element, said second contact electrically coupled to said shield.

2. An electrical connector according to claim 1 wherein said cast element comprises a laterally open holding channel receiving said electrical element and said insulation mass between said cable and said first contact, said electrical element being embedded in said insulation mass.

3. An electrical connector according to claim 2 wherein said cast element comprises a holder part supporting and insulating said first and second contacts.

4. An electrical connector according to claim 1 wherein said cast element comprises a holder part supporting and insulating said first and second contacts.

5. An electrical connector according to claim 1 wherein said cable is coaxial with said first conductor being an inner conductor and with said second conductor being an outer conductor.

6. An electrical connector according to claim 1 wherein said insulating material of said cast element is plastic; and said cast element comprises a laterally open holding channel receiving said electrical element.

7. An element connector according to claim 1 wherein a unitary holder part supporting and insulating said first and second contacts is directly coupled to said cast element.

8. An electrical connector according to claim 1 wherein a unitary holder part supporting and insulating said first and second contacts is directly coupled to said cast element.

9. An electrical connector according to claim 7 wherein said cable is coaxial with said first conductor being an inner conductor and with said second conductor being an outer conductor.

* * * * *